United States Patent [19]

Soeda et al.

[11] 4,262,472

[45] Apr. 21, 1981

[54] GAS FILLING METHOD

[75] Inventors: Yuji Soeda, Hatano; Akio Goto, Isehara, both of Japan

[73] Assignee: Tokico Ltd., Kanagawa, Japan

[21] Appl. No.: 62,574

[22] Filed: Jul. 31, 1979

Related U.S. Application Data

[63] Continuation of Ser. No. 886,574, Mar. 14, 1978, abandoned.

[51] Int. Cl.[3] ..... B65B 31/04

[52] U.S. Cl. ..... 53/403; 53/492

[58] Field of Search ..... 53/403, 404, 432, 433, 53/80, 81, 82, 83, 86, 88, 510, 492; 228/170; 83/108

[56] References Cited

U.S. PATENT DOCUMENTS

| | | | |
|---|---|---|---|
| 3,081,587 | 3/1963 | Heckethorn | 53/404 |
| 3,247,640 | 4/1966 | Miles et al. | 53/404 X |
| 3,668,820 | 6/1972 | Parvin et al. | 53/510 |

*Primary Examiner*—John Sipos

*Attorney, Agent, or Firm*—Wenderoth, Lind & Ponack

[57] ABSTRACT

A method for filling gas into a container comprises the steps of forming a severed portion through the wall of the container, deforming outwardly a wall portion of the container adjacent to the severed portion so as to form a projecting portion, whereby a gas introducing passage communicating across the wall of the container is formed, supplying pressurized gas into the container through the passage, and deforming the projecting portion inwardly to close the gas introducing passage.

1 Claim, 4 Drawing Figures

GAS FILLING METHOD

This is a continuation, of application Ser. No. 886,574, filed Mar. 14, 1978, now abandoned.

BACKGROUND OF THE INVENTION

This invention relates to a method for filling gas into a container such as an oleo-pneumatic shock absorber, a gas spring or the like containing high pressure gas therein.

One prior art method for filling high pressure gas into a container consists of forming a small hole in one end wall of the container, filling gas into the container through the opening, and thereafter closing the opening by inserting a plug or the like therein and welding the plug to the container.

In such case, difficulties are encountered in that it is necessary to remove burrs or the like from the inner edge of the opening, thereby decreasing the working efficiency, that it is necessary to fabricate the plug separately from the container, thereby increasing the cost for the machining operation, and that it is necessary to control the material of the plug carefully since the plug is formed separately from the container.

BRIEF SUMMARY OF THE INVENTION

An object of the present invention is to overcome the difficulties aforementioned by providing a novel method for filling pressurized gas into a container comprising the steps of forming a severed portion through the wall of the container, deforming outwardly a portion of the wall of the container at a position adjacent to the severed portion, so as to form an outwardly projecting portion thereby forming a gas introducing passage extending across the wall of the container, introducing pressurized gas into the container through the passage, and deforming the projecting portion inwardly so that the projecting portion acts to close the gas introducing passage.

BRIEF DESCRIPTION OF THE DRAWINGS

The present invention will be explained further hereinafter, by way of example, with reference to the accompanying drawings, in which.

Figure 1:
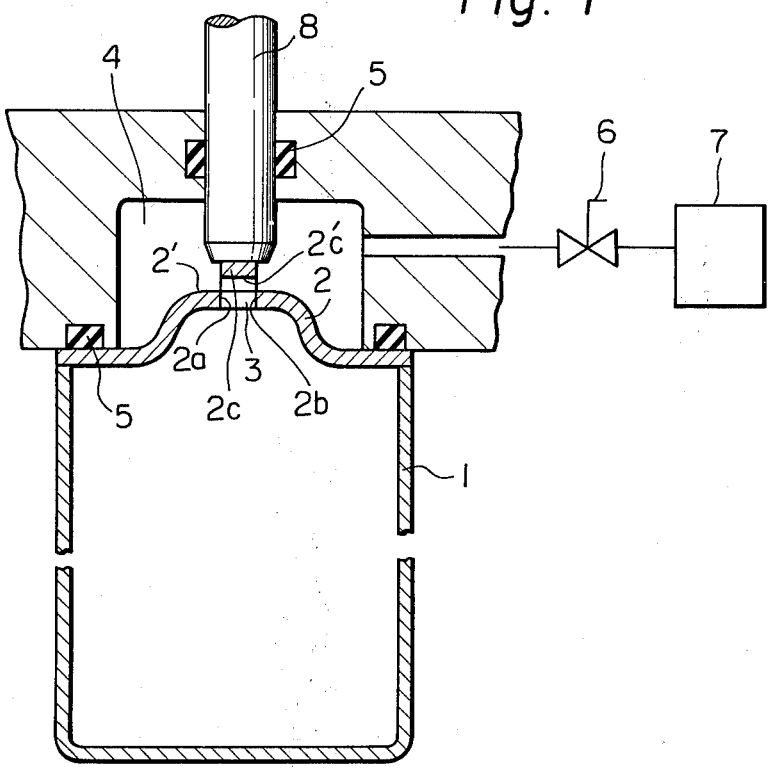
FIG. 1 is a schematic view showing a gas filling method according to the present invention.
Figure 2:
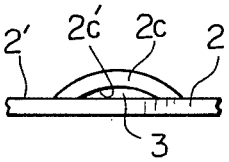
FIG. 2 is a partial side view showing a portion of the container of FIG. 1.

DETAILED DESCRIPTION OF PREFERRED EMBODIMENTS:

As shown in FIGS. 1 and 2, two parallel cut or severed lines 2*a* and 2*b* extending in the direction perpendicular to the plane of FIG. 1 and formed in a metal cap member 2 which closes one end of a container 1. A wall portion defined between the cut lines 2*a* and 2*b* is deformed outwardly of the container 1 so as to form an arcuate projecting portion 2*c*, as shown in FIG. 2, whereby a passage 3 is formed across the cap 2. The passage 3 acts as a gas introducing passage in supplying pressurized gas into the container 1.

The container 1 having the passage 3 formed therein is positioned at least partly in a closed chamber 4 with the passage 3 being exposed in the chamber 4, and the outer periphery of the chamber 4 is sealed from the outside by a seal member 5. Pressurized gas is introduced into the chamber 4 from a source 7 of pressurized gas by opening a valve 6, whereby pressurized gas introduced into the chamber 4 is supplied into the container 1 through the passage 3. After supplying a predetermined amount of pressurized gas into the container 1, an electrode 8 is moved downward in FIG. 1 to deform the projecting portion so that the inner surface 2*c*′ of the projecting portion 2*c* engages with the outer surface 2′ of the cap member 2 to close the passage 3, thereafter, the engaging portion between the projecting portion 2*c* and the surface portion 2′ are welded together by resistance welding employing electrode 8.

Figure 4:
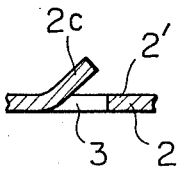
FIG. 4 is a cross-sectional view taken along line IV—IV in FIG. 3.
Figure 3:
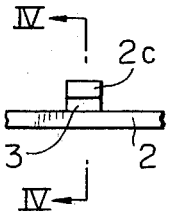
FIG. 3 is a partial side view showing another embodiment of the present invention.

Another embodiment of the present invention is shown in FIGS. 3 and 4. In the first embodiment, the gas introducing passage 3 is formed by cutting a portion of the cap member 2 along two parallel lines 2*a* and 2*b* and deforming outwardly a wall portion defined between the two lines, while, in the second embodiment, a generally rectangular projecting portion 2*c* is formed by cutting the cap 2 along three sides of a rectangle and bending the rectangle outwardly around the remaining one side of the rectangle to form a gas introducing passage 3. The outwardly bent rectangle or projecting portion 2*c* can act to close the passage 3.

In the illustrated embodiments, the projecting portions 2*c* may be formed by press work manufacturing of the cap 2, and thus, any additional process operation is not required.

As described heretofore, the gas filling method according to the present invention comprises the steps of forming a severed portion extending through a wall portion of a container, forming a gas introducing passage by deforming outwardly a wall portion adjacent to the severed portion, supplying pressurized gas into the container through the gas introducing passage, and deforming inwardly the wall portion which has been deformed outwardly in the preceeding step, thereby closing the gas introducing passage. Thus, a plug for closing a gas introducing passage according to the prior art method can be dispensed with and the complicated and expensive machining operation which has been required in the prior art method can be avoided.

What is claimed is:

1. A method of filling gas into a gas spring or shock absorber, said method comprising the steps of:

providing a gas spring or shock absorber having a metal end wall;

forming two spaced cut lines in said metal end wall with a wall portion defined between said two spaced cut lines;

deforming outwardly said wall portion defined between said two spaced cut lines, and thereby forming a gas introducing passage through said cut lines;

supplying pressurized gas into said gas spring or shock absorber through said gas introducing passage;

deforming inwardly said wall portion by applying thereto a pressing force by means of an electrode of a resistance welding device, thereby closing said gas introducing passage; and thereafter permanently securing the the inwardly deformed wall portion to said metal end wall by resistance welding with said electrode, thereby forming a gas filled gas spring or shock absorber.

* * * * *